United States Patent [19]

Liou

[11] Patent Number: 4,796,492

[45] Date of Patent: Jan. 10, 1989

[54] CLUTCH TYPE SOCKET WRENCH

[76] Inventor: Mou-Tang Liou, No. 33, Hsi-hu Rd., Ta-Lee Hsiang, Taichung Hsien, Taiwan

[21] Appl. No.: 196,311

[22] Filed: May 20, 1988

[51] Int. Cl.[4] ..... B25B 13/46

[52] U.S. Cl. ..... 81/58; 81/58.4

[58] Field of Search ..... 81/58–58.5

[56] References Cited

FOREIGN PATENT DOCUMENTS 3986 6/1901 Denmark ..... 81/58.4

*Primary Examiner*—Debra Meislin

*Attorney, Agent, or Firm*—Ladas & Parry

[57] ABSTRACT

A socket wrench comprises a handled hollow head receiving a torque transmitting sleeve member which is provided with peripheral teeth to engage with inwardly extending teeth of the hollow head. The teeth of both the hollow head and the sleeve member are elongated axially and formed in such a manner that their height from their intermediate portion gradually reduces towards the two ends thereof and their intermediate portion is notched to receive a C-shaped locking ring that interengages the hollow head and the sleeve member. The teeth can engage with each other when the handle is turned upward or downward to cause the axis of the hollow head to incline the axis of the sleeve, and to disengage from each other when the axis of the hollow head is in alignment with that of the sleeve.

4 Claims, 6 Drawing Sheets

CLUTCH TYPE SOCKET WRENCH

BACKGROUND OF THE INVENTION

This invention relates to a socket wrench and particularly to a clutch type socket wrench.

Wrenches having a torque transmitting socket which can engage with and disengage from a handled hollow head by means of a ratchet mechanism are known in the art. FIG. 1 shows a conventional wrench which has a direction changing knob 1 incorporating an adjusting pin 2 which is adapted to push or release a pawl member 3 to cause it to engage with or disengage from teeth 4 disposed in the inner periphery of the hollow head. The torque transmitting member of this device can transmit torque when it is turned clockwise or counter-clockwise by adjusting the knob 1. The handle of this device is pivoted at the periphery of the hollow head and has teeth 5 to engage a ball 6 so that the angle of the handle relative to the hollow head can be adjusted.

SUMMARY OF THE INVENTION

An object of the invention is to provide a novel socket wrench of simple construction which can be easily manufactured.

Another object of the invention is to provide a socket wrench which has a handled hollow head receiving a torque transmitting sleeve member, the hollow head and the sleeve being provided with teeth which can engage with each other when the handle is turned upward or downward to cause the axis of the hollow head to incline the axis of the sleeve, and which can disengage from each other when the axis of the hollow head is in alignment with that of the sleeve, i.e. the handle is placed in a position parallel to a surface to which a workpiece is attached.

The invention provides a socket wrench which comprises a handled hollow head whose inner periphery has at least two pairs of spaced apart first teeth elongated axially and extending inward at two diametrically opposite positions. The inner periphery of the hollow has a first annular groove extending across each first tooth, each first tooth having a notch where the annular groove passes across which separates each tooth into two parts. Each part of each tooth gradually decreases in height from a point adjacent to the notch towards one of the open ends of the hollow head. A torque transmitting sleeve member is inserted in the hollow head and has an axial length greater than that of the hollow head. The sleeve member has two opposite open ends extending out from the hollow head, and an outer periphery provided with a plurality of second teeth elongated axially and extending radially therefrom. The outer periphery further has a second annular groove extending across the second teeth. Each second tooth has a second notch where the second annular groove passes across which separates each second tooth into two parts. Each part of each second tooth gradually decreases in height from a point adjacent to the second notch towards one of the open ends of the sleeve member. A substantially C-shaped locking ring is inserted in the second annular groove and extends partially into the first annular groove. The C-shaped locking ring is restricted from moving axially relative to the sleeve member. The first annular groove has a width greater than that of the second annular groove, thus permitting the hollow head to move axially to a limited amount relative to the sleeve member.

The present exemplary preferred embodiment will be described in detail with reference to the accompanying drawings, in which:

DETAILED DESCRIPTION OF THE PREFERRED EMBODIMENT

Figure 1:
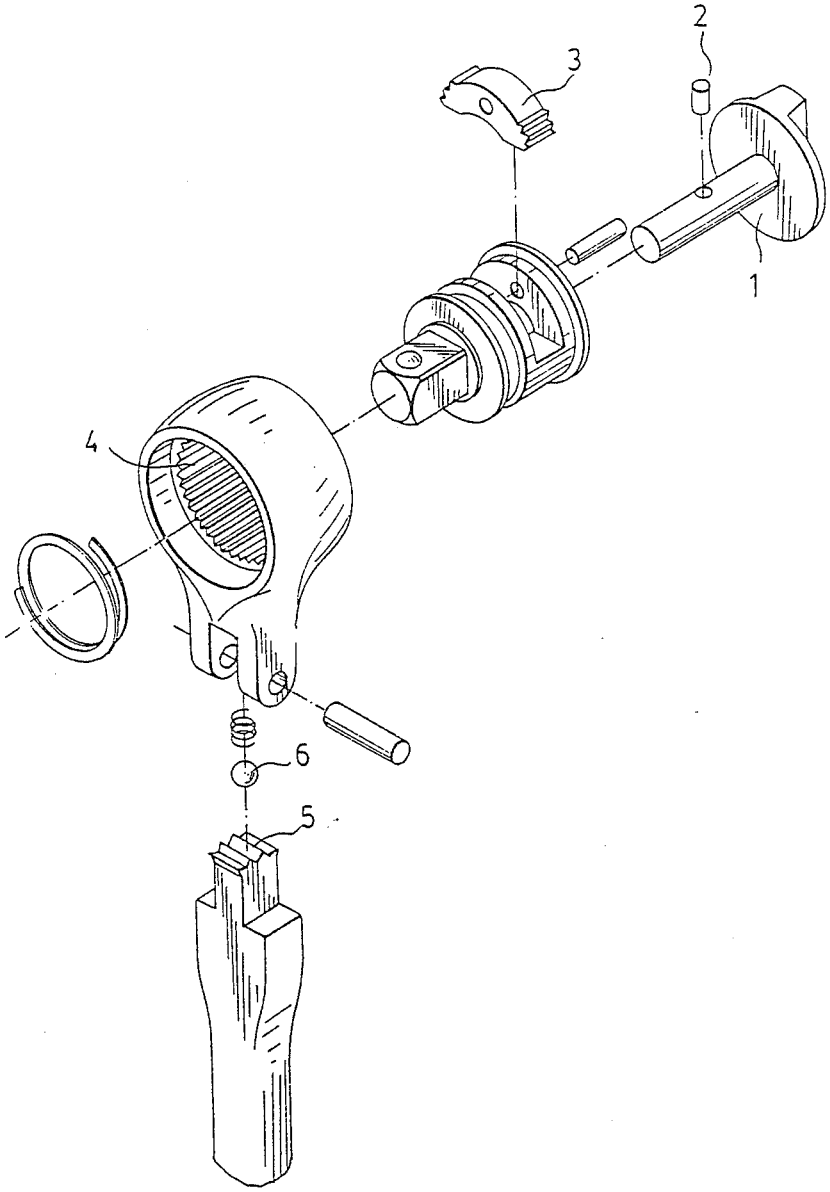
PRIOR ART FIG. 1
FIG. 1 shows a wrench in the prior art.

Referring to the drawings, a clutch type wrench is shown having a handle 10 which has a cylindrical hollow head 11 formed integrally therewith. The hollow head 11 has an inner periphery 12 on which are formed two pairs of teeth 13 elongated in an axial direction and extending inward. Each pair of teeth 13 are disposed at a diametrically opposite position with the other. An annular groove 14 extends along the circumferential length of the inner periphery 12, passing across the teeth 13. Each tooth 13 is notched where the annular groove 13 passes across in such a manner that the tooth 13 has two opposing parallel faces 151 to confine a notch 15 which divides the tooth 13 into two parts. The two parts of each tooth 13 gradually decreases in height from the notch 15 respectively towards the two open ends of the hollow head so that a slanted face 16 is formed on each part of each tooth 13.

A torque transmitting socket or sleeve member 20 is inserted in the hollow head 11. The axial dimension of the sleeve member 20 is greater than that of the hollow head 11 so that two opposing ends 25 and 26 of the sleeve member 20 extends out of the hollow head 11. The sleeve member 20 has an outer periphery 21 provided with a plurality of teeth 22 elongated axially and extending radially. The outer periphery 12 further has an annular groove 23 extending around the outer periphery and passing across the teeth 22. Each tooth 22 is notched where the annular groove 23 passes and is thus separated into two parts. Each part of the tooth 22 decreases gradually in height from the point near the annular groove 23 toward one of the open ends of the sleeve member 20 so that a slanted face 24 is formed on each part of each tooth 22.

A substantially C-shaped locking ring 30 is inserted in the annular groove 23 of the sleeve member 20 and extends partially into the annular groove 14 of the hollow head. The thickness of the C-shaped locking ring 30 is substantially similar to the width of the annular groove 23 so that the ring 30 is fitted snugly in the groove 23 and the sleeve member 20 is restricted from moving axially relative to the hollow member 11.

In assembly, the C-shaped ring 30 is inserted in the annular groove 23 of the sleeve member 20 and then the sleeve member 20 is inserted into the hollow head 11. The annular groove 14 has a width greater than that of the annular groove 23 and therefore permits the hollow member 11 to move axially a limited amount relative to the ring 30 and the sleeve member 20. Since the teeth 13 are provided with parallel faces 151 at their notches 15, the C-shaped rings will never be released from the annular groove.

Figure 4:
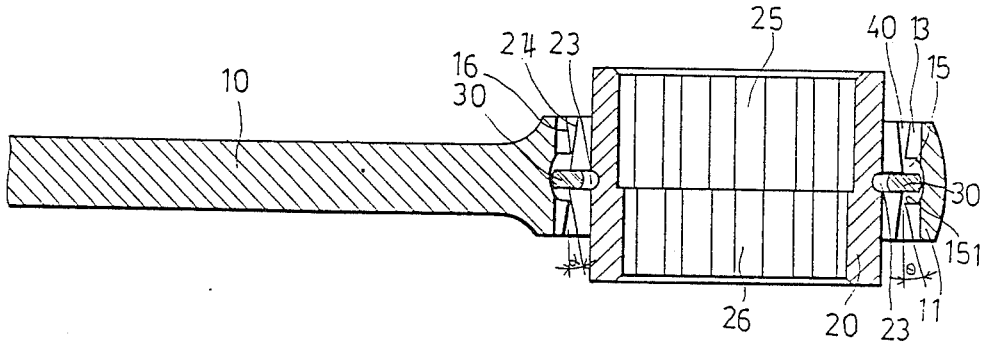
FIG. 4 is a sectional view of the wrench of FIG. 1 in an inoperative position.
Figure 5:
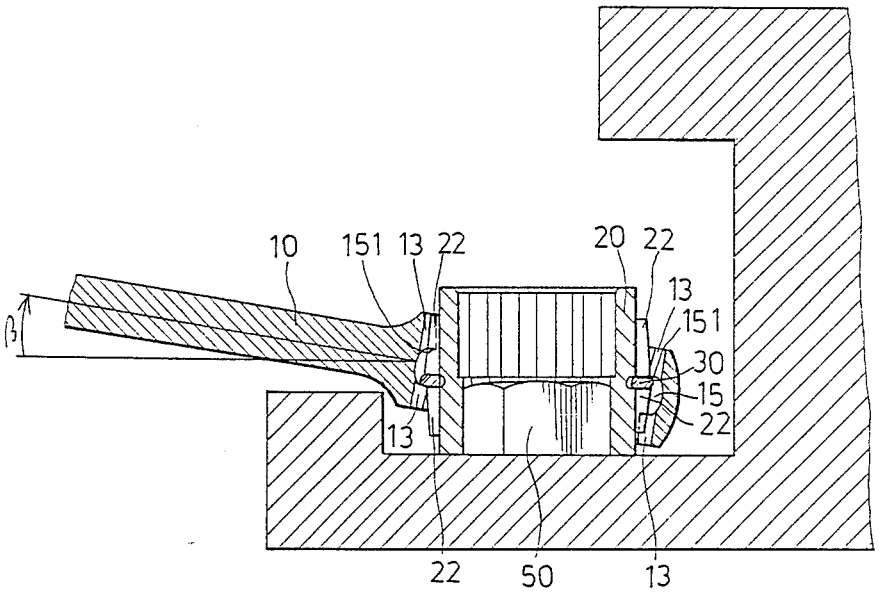
FIGS. 5 and 6 are sectional views of the wrench of FIG. 1 in an operative position.
Figure 6:
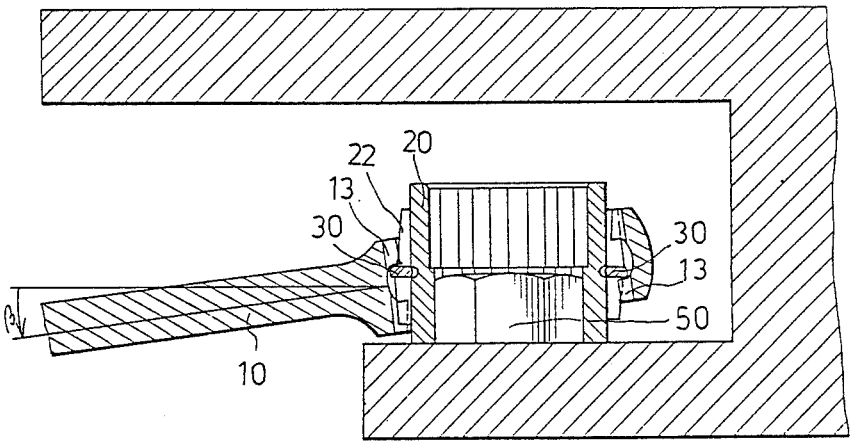

In operation, the sleeve member 20 is sleeved around a workpiece 50 and the handle 10 is turned by the operator. When the handle 10 is placed in a position parallel to a plane perpendicular to the axis of the sleeve member 20 as shown in FIG. 4, the teeth 13 and 22 do not engage with each other so that, although the handle 10 is turned clockwise or counterclockwise, the torque transmitting sleeve member 20 is inoperative. When the handle 10 is turned upward as shown in FIG. 5, the axis of the hollow head 11 inclines to the axis of the sleeve member 20. In this situation, the teeth 13 are moved and both upper and lower parts of the teeth 13 engage respectively with the upper and lower parts of the teeth 22 of the sleeve member 20. When the handle 10 is turned downward, the teeth 13 and 22 can also engage with each other as shown in FIG. 6.

It can be noted that one can easily lever the handle of the wrench of the invention by turning the handle upward or downward to move it forward and then placing the handle in a position parallel to the surface to which the workpiece is attached, so as to move the handle backward. The upward or downward inclining angle $\beta$ of the handle relative to the plane to which the workpiece is attached depends on the angle $\alpha$ of the slanted face 24 of the teeth 22 plus the angle $\theta$ of the slanted face 16 of the teeth 13.

Figure 2:
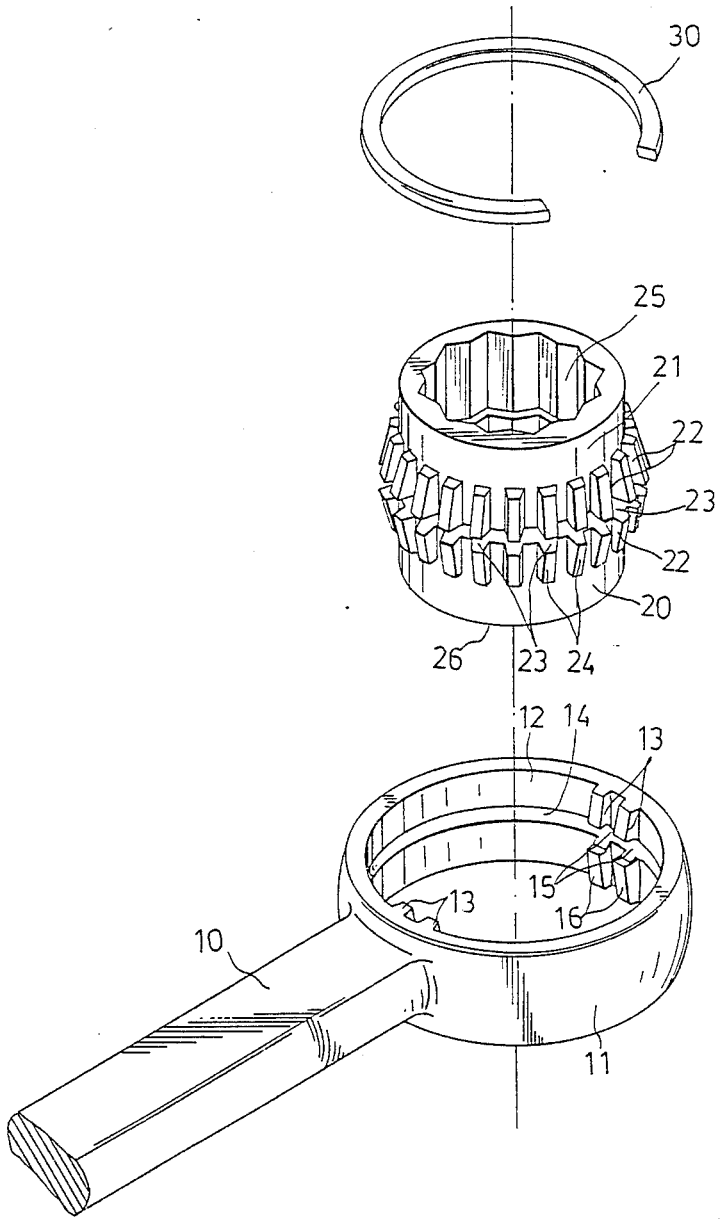
FIG. 2 is an exploded view of a clutch type wrench according to the present invention.
Figure 3:
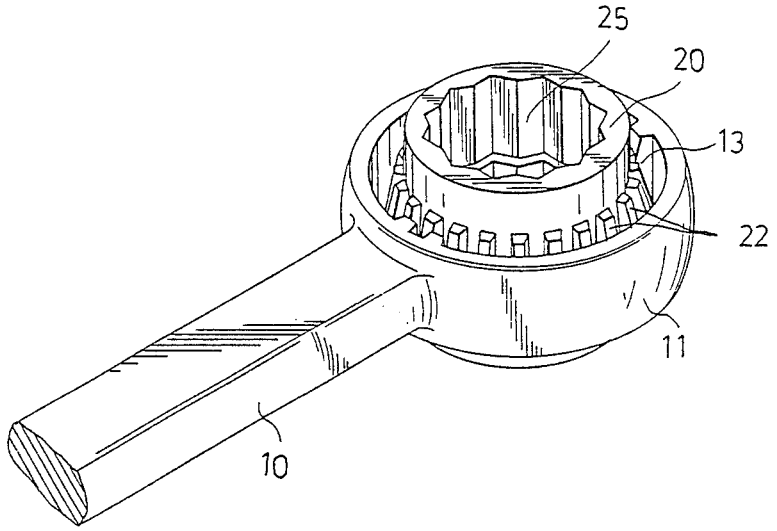
FIG. 3 is a perspective of the wrench of FIG. 2.
Figure 7A:
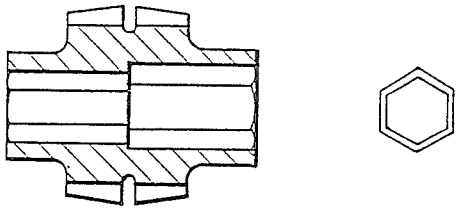
FIGS. 7A, 7B and 7C show different sockets or sleeve member of the wrench of FIG. 2 with different inner cross sections.
Figure 7B:
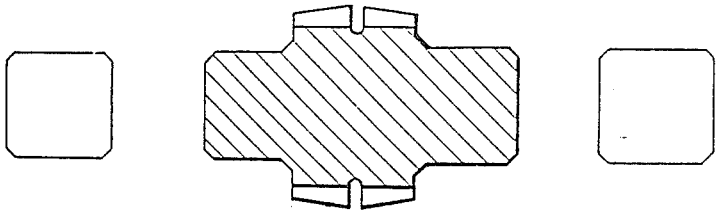
Figure 7C:
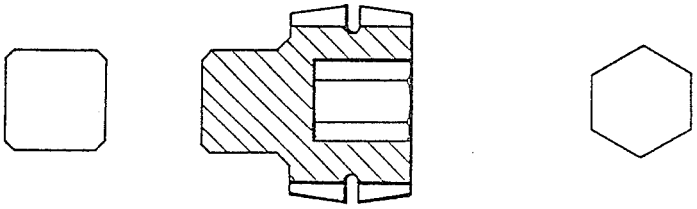

In addition to the sleeve member 20 which has an inner cross-section as shown in FIG. 2, the sleeve member of the present invention may have an inner cross-section as shown in any one of FIGS. 7A, 7B and 7C.

With the invention thus explained, it is apparent that numerous modifications and variation can be made without departing from the scope of the invention. It is therefore intended that the invention be limited as only indicated in the appended claims.

What I claim is:

1. A socket wrench comprising:

a one piece member having a cylindrical hollow head and a handle radially extending in a plane perpendicular to an axis of said hollow head, said hollow head having two opposite open ends and an inner peripheral surface, said inner peripheral surface having at least two pairs of spaced apart first teeth elongated axially and extending inward therefrom, each of said pairs of said first teeth being located at a position diametrically opposite to the other, said inner peripheral surface of said hollow head further having a first annular groove formed thereon, said first annular groove passing across each of said first teeth, each of said first teeth having a notch where said annular groove passes across and thus being separated into two first parts, each of said first parts of each of said first teeth having a gradually decreasing height from a point adjacent to said notch towards one of said open ends of said hollow head, a torque transmitting means including a sleeve member inserted in said hollow head and having an axial length greater than that of said hollow head, said sleeve member having two opposite open ends extending out of said hollow head, said sleeve member having an outer periphery provided with a plurality of second teeth elongated axially and extending radially therefrom, said outer periphery further having a second annular groove extending around said outer periphery and passing across said second teeth, each of said second teeth having a second notch where said second annular groove passes across and thus being separated into two parts, each of said two parts of said second teeth having a gradually decreasing height from a point adjacent to said second notch towards one of said open ends of said sleeve member, a substantially C-shaped locking ring inserted in said second annular groove and extending partially into said first annular groove, said C-shaped locking ring being restricted from moving axially relative to said sleeve member, said first annular groove having a width greater than that of said second annular groove, thus permitting said hollow head to move axially in a limited amount relative to said sleeve member, said first teeth and said second teeth being disengaged from each other when said sleeve and said hollow head are placed in a position in which the axis of said sleeve and said hollow head are in alignment, said first teeth and said second teeth being engaged with each other when the axis of said hollow head inclines to the axis of said sleeve.

2. A socket wrench as claimed in claim 1, wherein said said second annular groove has a width substantially similar to a thickness of said C-shaped locking ring so that said ring is fitted snugly in said second annular groove.

3. A socket wrench as claimed in claim 1, wherein each of said first teeth has two opposing parallel faces to confine each of said notches.

4. A socket wrench as claimed in claim 1, wherein said two parts of each of said first teeth substantially have the same dimension in an axial direction.

* * * * *